United States Patent [19]

Krosnick

[11] 4,353,550

[45] Oct. 12, 1982

[54] PADDLE BALL RACKET WITH ADJUSTMENT FOR FLEXING

[76] Inventor: Andrew Krosnick, 2404 Deerfield Rd., Far Rockaway, N.Y. 11691

[21] Appl. No.: 233,673

[22] Filed: Feb. 11, 1981

[51] Int. Cl.[3] ..... A63B 59/00

[52] U.S. Cl. ..... 273/67 R; 273/76

[58] Field of Search ..... 273/67 R, 67 D, 67 DA, 273/73 R, 73 C, 73 G, 73 J, 76

[56] References Cited

U.S. PATENT DOCUMENTS

| | | | |
|---|---|---|---|
| 1,961,473 | 6/1934 | Baltzley | 273/76 |
| 2,133,095 | 10/1938 | Holfelner | 145/61 M X |
| 2,603,260 | 7/1952 | Floren | 145/61 M X |

FOREIGN PATENT DOCUMENTS

| | | | |
|---|---|---|---|
| 2843640 | 4/1980 | Fed. Rep. of Germany | 273/73 J |
| 209845 | 1/1924 | United Kingdom | 273/73 J |
| 446324 | 4/1936 | United Kingdom | 273/67 DA |

*Primary Examiner*—Anton O. Oechsle

*Attorney, Agent, or Firm*—James P. Malone

[57] ABSTRACT

Paddle ball racket with flexing adjustment. A paddle member has a handle portion. First and second metal plates shaped like the handle portion are mounted on the sides of the handle portion. First and second screws are mounted in the upper portion of the plates and a third screw is mounted in the lower portion of the plates to squeeze the plates together against the handle portion of the paddle. Whereby, the screws may be adjusted to adjust the flexibility of the paddle and therefore the hardness or softness of the shot.

3 Claims, 2 Drawing Figures

PADDLE BALL RACKET WITH ADJUSTMENT FOR FLEXING

TECHNICAL FIELD

This invention relates to paddle ball rackets and more particularly to paddle ball rackets having means to adjust the flexing of the racket when hitting a ball.

BACKGROUND ART

When using rackets such as paddle ball or tennis rackets the hardness or softness of the shot is a function of the flexing or rigidity of the racket. In tennis rackets this adjustment is made by adjusting the tightening of the strings.

Conventional paddle ball rackets do not have any equivalent adjustment.

THE INVENTION

The present invention provides a paddle ball racket with an adjustment of the flexing of the paddle. The flexing area is the area of the paddle just above the handle portion which flexes when the ball is hit.

More specifically, the present invention provides means for adjusting the flexing of the paddle comprising a pair of metal plates which sandwich the handle portion of the paddle. The metal plate may be adjustably screwed together to squeeze the handle portion of the paddle and thereby adjust the flexibility of the hitting area of the paddle.

OBJECTS OF THE INVENTION

Accordingly, a principal object of the invention is to provide new and improved paddle ball means.

Another object of the invention is to provide new and improved paddle ball means having means to adjust the flexing of the paddle when hitting a ball.

Another object of the invention is to provide new and improved paddle ball racket means comprising, a paddle member having a handle portion, first and second plates shaped like the handle portion, the first and second plates being mounted in first and second sides of the handle portion, first and second screws mounted in the upper portion of the plates and a third screw mounted in the lower portion of the plates to squeeze the plates together against the handle portion of the paddle, whereby the screws may be adjusted to adjust the flexibility of the paddle.

BEST MODE OF THE INVENTION

Figures 1, 2:
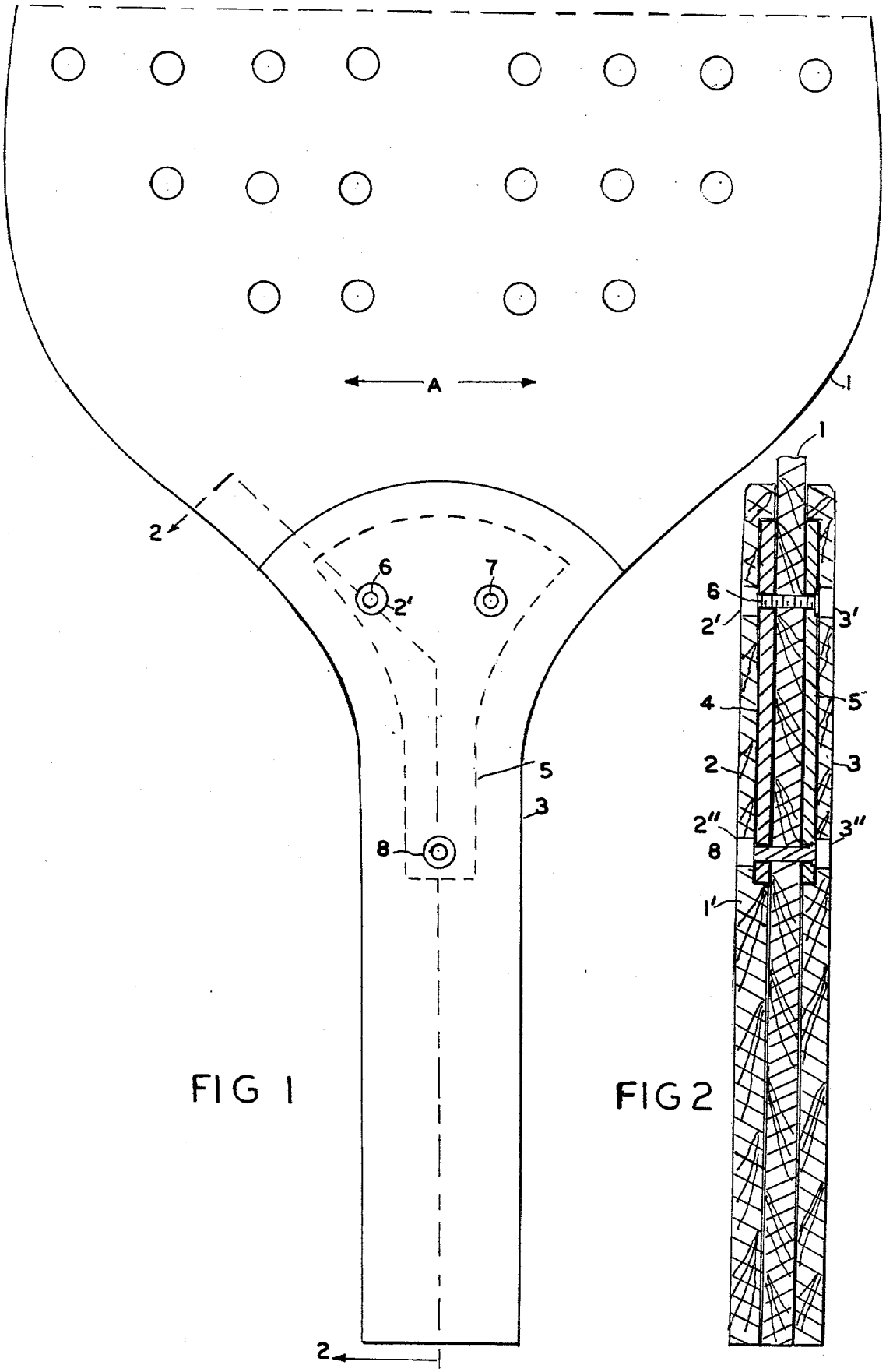
FIG. 1 is a partial plan view of an embodiment of the invention.
FIG. 2 is a sectional view of the handle portion of FIG. 1.

Referring to FIGS. 1 and 2, the paddle ball racket comprises a paddle member 1, which is generally of wood. The paddle member has a handle portion 1' and on either side of the paddle member are mounted two hand holding members 2 and 3. Recessed in the handle holding members are a pair of plates 4 and 5, which are preferably of metal. The plates are set into recesses in the hand holding members.

First and second screws 6 and 7 are mounted in threaded openings in the plate 4, and are accessible through holes 2' and 3' in the handle members. The screws may be Allen type screws. A third screw 8, is mounted in the lower portion of the metal plate members and is similarly threaded in the plate 4 and accessible through holes 2'' and 3'' in the hand holding member.

By adjustably tightening the screws 6 and 7, for instance with an Allen wrench, the plates 4 and 5 are squeezed on to the handle portion 1'. This affects the flexibility of the racket in the area A. By tightening the screws, the handle member is more rigidly connected to the paddle member which increases the stiffness of the paddle member in the area A where it normally flexes when hitting the ball. Therefore, by adjusting the screws 6 and 7 the flexing or rigidity of the paddle member 1 can be adjusted to provide a harder or softer shot when hitting the ball. Vibration in the handle may be minimized by mounting rubber or equivalent material between the plates and the handle portion.

It is claimed:

1. Paddle ball racket comprising:

a paddle member having a handle portion, first and second plates shaped like the handle portion, the first and second plates being mounted on first and second sides of the handle portion, first and second laterally spaced screws mounted in the upper portion of the plates and a third screw mounted on the lower portion of the plates to squeeze the plates together against the handle portion of the paddle, whereby the screws may be adjusted to adjust the flexibility of the paddle.

2. Apparatus as in claim 1 having first and second hand grips connected to the first and second plates.

3. Apparatus as in claim 2 wherein the plates are metal.

* * * * *